US005282957A

United States Patent [19]

Wright et al.

[11] Patent Number: 5,282,957

[45] Date of Patent: Feb. 1, 1994

[54] METHODS FOR INHIBITING POLYMERIZATION OF HYDROCARBONS UTILIZING A HYDROXYALKYLHYDROXYLAMINE

[75] Inventors: Bruce E. Wright, The Woodlands; Carl E. Weaver, Conroe; Dwight K. Reid, Houston, all of Tex.

[73] Assignee: Betz Laboratories, Inc., Trevose, Pa.

[21] Appl. No.: 932,126

[22] Filed: Aug. 19, 1992

[51] Int. Cl.[5] ..... C10G 9/16

[52] U.S. Cl. ..... 208/48 AA; 585/950; 203/8; 203/9

[58] Field of Search ..... 208/48 AA; 203/8, 9; 585/950; 252/401, 405

[56] References Cited

U.S. PATENT DOCUMENTS

| | | | |
|---|---|---|---|
| 3,148,225 | 9/1964 | Albert | 203/9 |
| 3,324,043 | 6/1967 | Krum | 252/405 |
| 3,408,422 | 10/1968 | May | 524/236 |
| 3,644,278 | 2/1972 | Klemchuk | 524/100 |
| 3,778,464 | 12/1973 | Klemchuk | 564/224 |
| 4,425,223 | 1/1984 | Miller | 208/48 AA |
| 4,440,625 | 4/1984 | Go et al. | 208/48 AA |
| 4,456,526 | 6/1984 | Miller et al. | 208/48 AA |
| 4,551,226 | 11/1985 | Ferm | 585/950 |
| 4,575,455 | 3/1986 | Miller | 252/403 |
| 4,649,221 | 3/1987 | Ravichandran et al. | 564/300 |
| 4,797,504 | 1/1989 | Roling | 560/4 |
| 4,840,720 | 6/1989 | Reid | 208/48 AA |
| 5,173,213 | 12/1992 | Miller et al. | 208/48 AA |

*Primary Examiner*—Mark L. Bell
*Assistant Examiner*—W. Griffin
*Attorney, Agent, or Firm*—Alexander D. Ricci; Philip H. Von Neida

[57] ABSTRACT

The present invention pertains to methods and compositions for inhibiting polymerization of hydrocarbons during processing and storage. The methods comprise adding an effective amount of a hydroxyalkylhydroxylamine compound to the hydrocarbon sought to be treated.

10 Claims, No Drawings

METHODS FOR INHIBITING POLYMERIZATION OF HYDROCARBONS UTILIZING A HYDROXYALKYLHYDROXYLAMINE

FIELD OF THE INVENTION

The present invention pertains to methods and compositions for inhibiting the undesired polymerization of hydrocarbon fluids and the subsequent fouling of processing equipment and product in storage tanks. More particularly, the present invention relates to the use of hydroxyalkylhydroxylamines as polymerization inhibitors in dissolved oxygen-containing hydrocarbon fluids.

BACKGROUND OF THE INVENTION

Fouling can be defined as the accumulation of unwanted matter on heat transfer surfaces. This deposition can be very costly in refinery and petrochemical plants since it increases fuel usage, results in interrupted operations and production losses and increases maintenance costs.

Deposits are found in a variety of equipment: preheat exchangers, overhead condensers, furnaces, heat exchangers, fractionating towers, reboilers, compressors and reactor beds. These deposits are complex but they can be broadly characterized as organic and inorganic. They consist of metal oxides and sulfides, soluble organic metals, organic polymers, coke, salt and various other particulate matter.

The chemical composition of organic foulants is rarely identified completely. Organic fouling is caused by insoluble polymers which sometimes are degraded to coke. The polymers are usually formed by reactions of unsaturated hydrocarbons, although any hydrocarbon can polymerize. Generally, olefins tend to polymerize more readily than aromatics, which in turn polymerize more readily than paraffins. Trace organic materials containing Hetero atoms such as nitrogen, oxygen and sulfur also contribute to polymerization.

Polymers are generally formed by free radical chain reactions. These reactions, shown below, consist of two phases, an initiation phase and a propagation phase. In Reaction 1, the chain initiation reaction, a free radical represented by R., is formed (the symbol R. can be any hydrocarbon). These free radicals, which have-an odd electron, act as chain carriers. During chain propagation, additional free radicals are formed and the hydrocarbon molecules (R) grow larger and larger (see Reaction 2C), forming the unwanted polymers which accumulate on heat transfer surfaces.

Chain reactions can be triggered in several ways. In Reaction 1, heat starts the chain. Example: When a reactive molecule such as an olefin or a diolefin is heated, a free radical is produced. Another way a chain reaction starts is shown in Reaction 3. Metal ions initiate free radical formation here. Accelerating polymerization by oxygen and metals can be seen by reviewing Reactions 2 and 3.

As polymers form, more polymers begin to adhere to the heat transfer surfaces. This adherence results in dehydrogenation of the hydrocarbon and eventually the polymer is converted to coke.

1. Chain Initiation
   $R—H \rightarrow R. + H.$
2. Chain Propagation
   a. $R. + O_2 \rightarrow R—O—O.$ b. $R—O—O. + R'—H \rightarrow R. + R—O—O—H$
   c. $R'. + C{=}C \rightarrow R'—C—C. \rightarrow$ Polymer
3. Chain Initiation
   a. $Me^{++} + RH \rightarrow Me^{+}R. + H^{+}$
   b. $Me^{++} + R—O—O—H \rightarrow Me^{+}R—O—O. + H^{+}$
4. Chain Termination
   a. $R. + R. \rightarrow R—R'$
   b. $R. + R—O—O. \rightarrow R—O—O—R$ In refineries, deposits usually contain both organic and inorganic compounds. This makes the identification of the exact cause of fouling extremely difficult. Even if it were possible to precisely identify every single deposit constituent, this would not guarantee uncovering the cause of the problem. Assumptions are often erroneously made that if a deposit is predominantly a certain compound, then that compound is the cause of the fouling. In reality, oftentimes a minor constituent in the deposit could be acting as a binder, a catalyst, or in some other role that influences actual deposit formation.

The final form of the deposit as viewed by analytical chemists may not always indicate its origin or cause. Before openings, equipment is steamed, water-washed, or otherwise readied for inspection. During this preparation, fouling matter can be changed both physically and chemically. For example, water-soluble salts can be washed away or certain deposit constituents oxidized to another form.

In petrochemical plants, fouling matter is often organic in nature. Fouling can be severe when monomers convert to polymers before they leave the plant. This is most likely to happen in streams high in ethylene, propylene, butadiene, styrene and other unsaturates. Probable locations for such reactions include units where the unsaturates are being handled or purified, or in streams which contain these reactive materials only as contaminants.

Even through some petrochemical fouling problems seem similar, subtle differences in feedstock, processing schemes, processing equipment and type of contaminants can lead to variations in fouling severity. For example, ethylene plant depropanizer reboilers experience fouling that appears to be primarily polybutadiene in nature. The severity of the problem varies significantly from plant to plant, however. The average reboiler run length may vary from one to two weeks up to four to six months (without chemical treatment).

Although it is usually impractical to identify the fouling problem by analytical techniques alone, this information combined with knowledge of the process, processing conditions and the factors known to contribute to fouling, are all essential to understanding the problem.

There are many ways to reduce fouling both mechanically and chemically. Chemical additives often offer an effective anti-fouling means; however, processing changes, mechanical modifications equipment and other methods available to the plant should not-be overlooked.

Antifoulant chemicals are formulated from several materials: some prevent foulants from forming, others prevent foulants from depositing on heat transfer equipment. Materials that prevent deposit formation include antioxidants, metal coordinators and corrosion inhibitors. Compounds that prevent deposition are surfactants which act as detergents or dispersants. Different combinations of these properties are blended together to maximize results for each different application. These "polyfunctional" antifoulants are generally more versatile and effective since they can be designed to combat various types of fouling that can be present in any given system.

Research indicates that even very small amounts of oxygen can cause or accelerate polymerization. Accordingly, anti-oxidant type antifoulants have been developed to prevent oxygen from initiating polymerization. Antioxidants act as chain-stoppers by forming inert molecules with the oxidized free radical hydrocarbons, in accordance with the following reaction:

Chain Termination $$ROO. + \text{Antioxidant} \longrightarrow ROOH + \text{Antioxidant}(-H)$$

Also, antioxidants can terminate the hydrocarbon radical as follows:

$$R. + \text{Antioxidant} \rightarrow RH + \text{Antioxidant}(-H)$$

Surface modifiers or detergents change metal surface characteristics to prevent foulants from depositing. Dispersants or stabilizers prevent insoluble polymers, coke and other particulate matter from agglomerating into large particles which can settle out of the process stream and adhere to the metal surfaces of process equipment. They also modify the particle surface so that polymerization cannot readily take place.

Antifoulants are designed to prevent equipment surfaces from fouling. They are not designed to clean up existing foulants. Therefore, an antifoulant should be started immediately after equipment is cleaned. It is usually advantageous to pretreat the system at double the recommended dosage for two or three weeks to reduce the initial high rate of fouling immediately after startup.

The increased profit possible with the use of antifoulants varies from application to application. It can include an increase in production, fuel savings, maintenance savings and other savings from greater operating efficiency.

There are many areas in the hydrocarbon processing industry where antifoulants have been used extensively; the main areas of treatment are discussed below.

In a refinery, the crude unit has been the focus of attention because of increased fuel costs. Antifoulants have been successfully applied at the exchangers; downstream and upstream of the desalter, on the product side of the preheat train, on both sides of the desalter makeup water exchanger and at the sour water stripper.

Hydrodesulfurization units of all types experience preheat fouling problems. Among those that have been successfully treated are reformer pretreaters processing both straight run and coker naphtha, desulfurizers processing catalytically cracked and coker gas oil, and distillate hydro-treaters. In one case, fouling of a Unifiner stripper column was solved by applying a corrosion inhibitor upstream of the problem source.

Unsaturated and saturated gas plants (refinery vapor recovery units) experience fouling in the various fractionation columns, reboilers and compressors. In some cases, a corrosion control program combined with an antifoulant program gave the best results. In other cases, an application of antifoulants alone was enough to solve the problem.

Cat cracker preheat exchanger fouling, both at the vacuum column and at the cat cracker itself, has also been corrected by the use of antifoulants.

The two most prevalent areas for fouling problems in petrochemical plants are at the ethylene and styrene plants. In an ethylene plant, the furnace gas compressors, the various fractionating columns and reboilers are subject to fouling. Polyfunctional antifoulants, for the most part, have provided good results in these areas. Fouling can also be a problem at the butadiene extraction area. Both antioxidants and polyfunctional antifoulants have been used with good results.

In the different design butadiene plants, absorption oil fouling and distillation column and reboiler fouling have been corrected with various types of antifoulants.

Chlorinated hydrocarbon plants, such as VCM, EDC and perchloroethane and trichloroethane have all experienced various types-of fouling problems. The metal coordinating/antioxidant-type antifoulants give excellent service in these areas.

SUMMARY OF THE INVENTION

The present invention relates to methods and compositions for inhibiting the polymerization of hydrocarbons during their processing and subsequent storage comprising adding a hydroxyalkyl hydroxylamine compound to the hydrocarbon.

The compounds of the present invention are effective at inhibiting the polymerization in olefinic hydrocarbons, particularly those olefinic hydrocarbons which contain dissolved oxygen gas.

DESCRIPTION OF THE RELATED ART

Past polymerization inhibitors have included phenylenediamine compounds, phenols, sulfur compounds and diethylhydroxylamine (DEHA). DEHA and phenylenediamine compounds are taught as polymerization inhibitors for acrylate monomers in U.S. Pat. No. 4,797,504. U.S. Pat. No. 4,425,223 teaches inhibiting fouling of heat exchangers during hydrocarbon processing by adding an alkyl ester of a phosphorous acid and a hydrocarbon sulfonic acid.

U.S. Pat. No. 4,440,625 discloses the use of a dialkylhydroxylamine compound and an organic surfactant to inhibit fouling in petroleum processing equipment. U.S. Pat. No. 4,456,526 teaches methods for inhibiting the fouling of petroleum processing equipment employing the composition of a dialkylhydroxylamine and a tertiary alkylcatechol.

U.S. Pat. No. 4,840,720 discloses a process for inhibiting the degradation of and gum formation in distillate fuel oils before and during processing. The process employs a combination of a phosphite compound and a hydroxylamine compound. U.S. Pat. No. 4,649,221 teaches a method for preparing polyhydroxylamine stabilizing compounds.

DETAILED DESCRIPTION OF THE INVENTION

The present invention relates to methods and compositions for inhibiting the polymerization of hydrocarbon fluids containing dissolved oxygen comprising adding to said hydrocarbon an effective amount of a hydroxyalkylhydroxylamine compound. The hydroxyalkylhydroxylamine compounds of the present invention generally have the formula

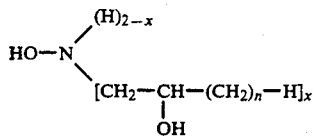

wherein n ranges from about 0 to about 10 and x is 1 or 2. Preferably, the compounds utilized in the present invention are bis-(hydroxypropyl)hydroxylamine, bis-(hydroxybutyl)hydroxylamine, hydroxypropylhydroxylamine and hydroxybutylhydroxylamine. Mixtures of two or more hydroxyalkylhydroxylamine compounds may also be effectively used in the methods of the present invention.

The total amount of hydroxyalkylhydroxylamine compound used in the methods and compositions of the present invention is that amount which is sufficient to inhibit polymerization and will vary according to the conditions under which the hydrocarbon is being processed. At higher processing temperatures and during longer storage periods, larger amounts of polymerization inhibitors are generally required.

The hydroxyalkylhydroxylamine compounds may be added to the hydrocarbon in an amount ranging from about 1 to about 1000 parts per million parts hydrocarbon. Preferably, the compounds of the present invention are added to the hydrocarbon in an amount from about 1 to about 100 parts per million parts hydrocarbon.

The polymerization inhibiting compositions of the present invention can be introduced into the processing equipment by any conventional method. Other polymerization inhibiting compounds may be used in combination with the compounds of the present invention. Dispersants and corrosion inhibitors-may also be combined with the compounds of the present invention to improve the efficiency of these compositions or to provide additional protection to the process equipment.

The methods and compositions of the present invention can control the fouling of processing equipment which is due to or caused by the polymerization of the hydrocarbon being processed. The methods of the instant invention may be employed during preparation and processing as a process inhibitor and as a product inhibitor which is combined with the hydrocarbon in order to inhibit polymerization of the hydrocarbon during storage and handling.

The compounds of the present invention may be added neat or in a suitable carrier solvent that is compatible with the hydrocarbon. Preferably, a solution is provided and the solvent is an organic solvent such as octanol.

As used herein, "Hydrocarbons" signify various and sundry petroleum hydrocarbons and petroleum hydrocarbons such as petroleum hydrocarbon feedstocks including crude oils and fractions thereof such as naphtha, gasoline, kerosene, diesel, jet fuel, fuel oil, gas oil, vacuum residue, etc., may all be benefitted by the polymerization inhibitor herein disclosed.

In order to more clearly illustrate this invention, the data set forth below was developed. The following examples are included as being illustrations of the invention and should not be construed as limiting the scope thereof.

EXAMPLES

Numerous hydroxyalkylhydroxylamine compounds were used to perform the test work. The samples employed had various concentrations as indicated in Table 1.

TABLE I

PROPERTIES OF THE HYDROXYLAMINE SAMPLES

| LOT NO | PERCENT ACTIVE HYDROXY-LAMINE | TYPE OF HYDROXY-LAMINE | OTHER INFORMATION |
|---|---|---|---|
| 1507-133-2 | 95–100 | HPHA | Received Undiluted |
| 1507-160-2 | 95–100 | HPHA | Received Undiluted |
| 1507-165-3 | 95–100 | HPHA | Received Undiluted |
| 1507-177-2 | 88–89 | HPHA | About 10% solvent plus 1 to 2% $H_2O$ |
| 1507-179-22 | 95–100 | HPHA | Received Undiluted |
| Very limited amount of test work run on the above samples | | | |
| 1507-183-3 | ~90 | HPHA | Received Undiluted; impure with significant amount of N-oxide & 2½% $H_2O$ |
| 1507-209-F | 93 | HBHA | Received Undiluted, 1% $H_2O$ |
| 1507-216-F | >90 | HPHA | Received Undiluted Very dry, 1.1% $H_2O$ |
| 1507-218-F | 35 | HPHA | Received Undiluted with lots of N-oxide, 3.1% $H_2O$ |
| 1507-225-F | 15 | HPHA | Received dilution in octanol, lots of N—OH (35%), but limited HPHA product (15%) |
| 1507-233-F | 47.5 | HPHA | Received dilution in octanol, mixture of amines |
| 1507-239-F | 47.5 | HPHA | Received dilution in octanol, ultra pure HPHA |
| 1507-248-F | 45 | HPHA | Received dilution in octanol, raw material 90% pure with mixed amines |
| 1507-250-F | 45 | HPHA | |
| 1507-276-2 | 42.5 | HPHA | Received dilution in octanol |
| 1581-13-3 | 45.3 | HPHA | Received dilution in octanol-thick paste |
| 1581-17-2 | 45.6 | HPHA | Received dilution in octanol-thick paste |

Oxygen stability tests, per ASTM D-525, were performed utilizing an ethylene plant raw pyrolysis gasoline, or an isoprene/heptane (20%/80%) mixture. The sample is initially saturated in a pressure vessel with oxygen under pressure. Pressure is monitored until the pressure break point is observed. The time required for the sample to reach this point is the induction time for the temperature at which the test is conducted. A longer induction time is indicative of better anti-polymerization. Testing results comparing the efficacy of various lots of HPHA and HBHA with DEHA are presented in Table II using a raw pyrolysis gasoline feedstock.

TABLE II

Oxygen Stability Results With Raw Pyrolysis Gasoline

| Treatment | Lot Number | Concentration (ppm active) | Induction Time (Min) |
|---|---|---|---|
| Blank | | — | 14 |
| DEHA | | 250 | 37 |
| HBHA | 1507-209-F | 233 | 30 |
| HPHA | 1507-183-3 | 225 | 61 |

TABLE II-continued

| Oxygen Stability Results With Raw Pyrolysis Gasoline | | | |
|---|---|---|---|
| Treatment | Lot Number | Concentration (ppm active) | Induction Time (Min) |
| HPHA | 1507-216-F | 225 | 52 |
| HPHA | 1507-218-F | 87.5 | 27 |

DEHA = diethylhydroxylamine
HBHA = bis-(hydroxybutyl)hydroxylamine
HPHA = bis-(hydroxypropyl)hydroxylamine These results indicate that the compounds of the present invention stabilize hydrocarbons as effectively as DEHA, a known polymerization inhibitor. Table III represents the results for 20%/80% isoprene/heptane.

TABLE III

| Oxygen Stability Results Using a Mixture of 20%/80% Isoprene/Heptane | | | |
|---|---|---|---|
| Treatment (ppm active) | Lot Number | Aged HPHA Sample Months | Induction Time (Min.) |
| Blank (62 Tests) | | | 43 +/− 11 |
| DEHA (250) | | | 73 |
| HPHA (222.5) | 1507-177-2 | 0 | 164 |
| HPHA (225.5) | 1507-177-2 | 3 | 95 |
| HPHA (222.5) | 1507-177-2 | 9 | 57 |
| HPHA (445) | 1507-177-2 | 9 | 92 |

DEHA = diethylhydroxylamine
HPHA = bis-(hydroxypropyl)hydroxylamine

The purity of the various hydroxyalkylhydroxylamine samples used in the testing ranged considerably. In general, efficacy was better for the more active and purer lots. As shown in Table III, the hydroxylamines tend to degrade and become less effective over time; therefore, it is important to use the material as rapidly as possible to achieve the most efficacious result.

The results in Tables II and III indicate the effectiveness of the inventive compounds at inhibiting polymerization in hydrocarbons containing dissolved oxygen. These results further indicate that the compounds of the present invention stabilize hydrocarbons as, or more effectively than DEHA, a known polymerization inhibitor.

The heat induced gum tests utilizes heat under a nitrogen atmosphere to induce polymer formation. Nitrogen overpressure is used in the closed oxidation stability vessels to minimize the amount of oxygen present and the reduce vaporization of the feedstock. The sample is then force evaporated to dryness with a nitrogen jet and the residue or gum is measured by weight. Effective inhibition is achieved by lower amounts of gum formed. These results are shown in Tables IV through XIV.

TABLE IV

| Heat Induced Gum Test With Raw Pyrolysis Gasoline (212° F.) Sample No. 1 | | | | | |
|---|---|---|---|---|---|
| | | Gum content after polymerization | | | |
| Treatment (ppm active) | Lot No. | Unwashed Gum (mg/100 ml) | % P | Heptane Washed Gum | % P |
| Blank | — | 469 | — | 414 | — |
| DEHA (100) | — | 388 | 17 | 354 | 14 |
| HBHA (93) | 1507-209-F | 431 | 8 | 354 | 14 |
| HPHA (90) | 1507-183-F | 487 | 0 | 418 | 0 |
| HPHA (90) | 1507-216-F | 365 | 22 | 349 | 16 |
| HPHA (35) | 1507-218-F | 463 | 0 | 448 | 0 |

Initial gums not determined
DEHA = diethylhydroxylamine
HBHA = bis-(hydroxybutyl)hydroxylamine
HPHA = bis-(hydroxypropyl)hydroxylamine% P = Percent Protection Based on Blanks The experimental error in these tests is +/− 10% in the percent protection. Treatment efficacy, in the above listed test, was absent. The treatment dosage was too low for this feedstock at these test conditions.

TABLE V

| Heat Induced Gum Test Using Raw Pyrolysis Gasoline (212° F.) Sample No. 2 | | | | | |
|---|---|---|---|---|---|
| | | Gum content after polymerization | | | |
| Treatment (ppm active) | Lot No. | Unwashed Gum (mg/100 ml) | % P | Heptane Washed Gum | % P |
| Blank | — | 382 | — | 361 | — |
| DEHA (100) | — | 321 | 16 | 295 | 17 |
| HBHA (93) | 1507-209-F | 379 | 0 | 355 | 0 |
| HPHA (90) | 1507-183-3 | 193 | 51 | 187 | 49 |
| HPHA (90) | 1507-216-F | 299 | 22 | 267 | 27 |
| HPHA (35) | 1507-218-F | 248 | 36 | 236 | 35 |

Initial gums = 8 mg/100 ml unwashed and heptane washed
DEHA = diethylhydroxylamine
HBHA = bis-(hydroxybutyl)hydroxylamine
HPHA = bis-(hydroxypropyl)hydroxylamine
% P = Percent Protection Based on Blanks In this new sample of raw pyrolysis gasoline, treatment levels were high enough to yield good efficacy.

TABLE VI

| Heat Induced Gum Test Using Raw Pyrolysis Gasoline (275° F.) Sample No. 2 | | | | | |
|---|---|---|---|---|---|
| | | Gum content after polymerization | | | |
| Treatment (ppm active) | Lot No. | Unwashed Gum (mg/100 ml) | % P | Heptane Washed Gum | % P |
| Blank | — | 1032 | — | 885 | — |
| DEHA (100) | — | 895 | 13 | 781 | 12 |
| HBHA (93) | 1507-209-F | 899 | 13 | 675 | 24 |
| HPHA (90) | 1507-183-3 | 904 | 13 | 677 | 24 |
| HPHA (90) | 1507-216-F | 854 | 17 | 721 | 19 |
| HPHA (35) | 1507-218-F | 906 | 12 | 786 | 11 |

Initial gums = 8 mg/100 ml unwashed and heptane washed
DEHA = diethylhydroxylamine
HBHA = bis-(hydroxybutyl)hydroxylamine
HPHA = bis-(hydroxypropyl)hydroxylamine
% P = Percent Protection Based on Blanks When run at higher temperatures (275° F.), much more polymer forms compared to tests run at lower temperatures (212° F.), and the treatments are not as effective at the same concentrations.

TABLE VII

| Heat Induced Gum Test Using Raw Pyrolysis Gasoline (275° F.) Sample No. 2 | | | | | |
|---|---|---|---|---|---|
| | | Gum content after polymerization | | | |
| Treatment (ppm active) | Lot No. | Unwashed Gum (mg/100 ml) | % P | Heptane Washed Gum | % P |
| Blank | — | 457 | — | 457 | — |
| DEHA (500) | — | 329 | 29 | 324 | 30 |
| HBHA (465) | 1507-209-F | 366 | 20 | 363 | 21 |
| HPHA (450) | 1507-183-3 | 220 | 53 | 205 | 56 |
| HPHA (450) | 1507-216-F | 288 | 38 | 282 | 39 |
| HPHA (175) | 1507-218-F | 323 | 30 | 321 | 30 |

Initial gums = 8 mg/100 ml unwashed and heptane washed
DEHA = diethylhydroxylamine
HBHA = bis-(hydroxybutyl)hydroxylamine
HPHA = bis-(hydroxypropyl)hydroxylamine
% P = Percent Protection Based on Blanks Greater treatment concentrations boost the efficacy achieved in the tests run at higher temperatures.

TABLE VIII

Heat Induced Gum Test Using Raw Pyrolysis Gasoline (212° F.) Sample No. 3

| Treatment (ppm active) | Lot No. | Gum content after polymerization: Unwashed Gum (mg/100 ml) | % P | Heptane Washed Gum | % P |
|---|---|---|---|---|---|
| Blank | — | 109 | — | 108 | — |
| DEHA (100) | — | 17 | 84 | 12 | 88 |
| HPHA (30) | 1507-225-F* | 61 | 44 | 61 | 44 |
| HPHA (95) | 1507-233-F | 118 | 0 | 116 | 0 |
| HPHA (95) | 1507-239-F | 20 | 82 | 18 | 83 |
| HPHA (90) | 1507-248-F | 94 | 14 | 94 | 13 |
| HPHA (90) | 1507-250-F | 50 | 54 | 49 | 55 |

Initial gums = 38 mg/100 ml unwashed and 34 mg/100 ml heptane washed
DEHA = diethylhydroxylamine
HPHA = bis-(hydroxypropyl)hydroxylamine
% P = Percent Protection Based on Blanks
*15% Pure HPHA, 35% other N—OH functionality Sample 1507-233-F was ineffective in this test and in those shown in Tables IX, X and XI. This sample of HPHA was analytically determined to be a mixture of amines, with little -NOH functionality, resulting in no efficacy.

TABLE IX

Heat Induced Gum Test Using Raw Pyrolysis Gasoline (212° F.) Sample No. 3

| Treatment (ppm active) | Lot No. | Gum content after polymerization: Unwashed Gum (mg/100 ml) | % P | Heptane Washed Gum | % P |
|---|---|---|---|---|---|
| Blank | — | 124 | — | 110 | — |
| DEHA (50) | — | 23 | 94 | 14 | 95 |
| HPHA (15) | 1507-225-F | 227 | 0 | 218 | 0 |
| HPHA (48) | 1507-233-F | 166 | 0 | 157 | 0 |
| HPHA (48) | 1507-239-F | 103 | 19 | 88 | 22 |
| HPHA (45) | 1507-248-F | 102 | 20 | 99 | 11 |
| HPHA (45) | 1507-250-F | 106 | 17 | 97 | 13 |

Initial gums = 16 mg/100 ml unwashed and 9 mg/100 ml heptane washed
DEHA = diethylhydroxylamine
HPHA = bis-(hydroxypropyl)hydroxylamine
% P = Percent Protection Based on Blanks

TABLE X

Heat Induced Gum Test Using Raw Pyrolysis Gasoline (275° F.) Sample No. 3

| Treatment (ppm active) | Lot No. | Gum content after polymerization: Unwashed Gum (mg/100 ml) | % P | Heptane Washed Gum | % P |
|---|---|---|---|---|---|
| Blank | — | 445 | — | 429 | — |
| DEHA (500) | — | 91 | 80 | 63 | 85 |
| HPHA (150) | 1507-225-F | 487 | 0 | 475 | 0 |
| HPHA (475) | 1507-233-F | 1178 | 0 | 720 | 0 |
| HPHA (475) | 1507-239-F | 227 | 49 | 221 | 48 |
| HPHA (450) | 1507-248-F | 164 | 63 | 155 | 64 |

Initial gums = 16 mg/100 ml unwashed and 9 mg/100 ml heptane washed
DEHA = diethylhydroxylamine
HPHA = bis-(hydroxypropyl)hydroxylamine
% P = Percent Protection Based on Blanks

TABLE XI

Heat Induced Gum Test Using Raw Pyrolysis Gasoline (275° F.) Sample No. 3

| Treatment (ppm active) | Lot No. | Gum content after polymerization: Unwashed Gum (mg/100 ml) | % P | Heptane Washed Gum | % P |
|---|---|---|---|---|---|
| Blank | — | 567 | — | 523 | — |
| DEHA (500) | — | 53 | 92 | 52 | 91 |
| HPHA (475) | 1507-233-F | 561 | 0 | 536 | 0 |
| HPHA (475) | 1507-239-F | 241 | 58 | 226 | 57 |
| HPHA (450) | 1507-248-F | 314 | 45 | 206 | 61 |

TABLE XI-continued

Heat Induced Gum Test Using Raw Pyrolysis Gasoline (275° F.) Sample No. 3

| Treatment (ppm active) | Lot No. | Gum content after polymerization: Unwashed Gum (mg/100 ml) | % P | Heptane Washed Gum | % P |
|---|---|---|---|---|---|
| HPHA (450) | 1507-250-F | 131 | 78 | 129 | 76 |

Initial gums = 7 mg/100 ml unwashed and 6 mg/100 ml heptane washed
DEHA = diethylhydroxylamine
HPHA = bis-(hydroxypropyl)hydroxylamine
% P = Percent Protection Based on Blanks

TABLE XII

Heat Induced Gum Test Using Raw Pyrolysis Gasoline (212° F.) Sample No. 3

| Treatment (ppm active) | Lot No. | Gum content after polymerization: Unwashed Gum (mg/100 ml) | % P | Heptane Washed Gum | % P |
|---|---|---|---|---|---|
| Blank | — | 115 | — | 111 | — |
| DEHA (100) | — | 21 | 92 | 16 | 95 |
| HPHA (90) | 1507-248-F | 61 | 53 | 31 | 80 |
| HPHA (90) | 1507-250-F | 67 | 47 | 66 | 45 |
| HPHA (85) | 1507-276-F | 18 | 95 | 6 | 100 |

Initial gums = 13 mg/100 ml unwashed and 11 mg/100 ml heptane washed
DEHA = diethylhydroxylamine
HPHA = bis-(hydroxypropyl)hydroxylamine
% P = Percent Protection Based on Blanks

TABLE XIII

Heat Induced Gum Test Using Raw Pyrolysis Gasoline (212° F.) Sample No. 3

| Treatment (ppm active) | Lot No. | Gum content after polymerization: Unwashed Gum (mg/100 ml) | % P | Heptane Washed Gum | % P |
|---|---|---|---|---|---|
| Blank | — | 133 | — | 129 | — |
| DEHA (100) | — | 127 | 0 | 109 | 18 |
| HPHA (90) | 1507-250-F | 140 | 0 | 138 | 0 |
| HPHA (90.6) | 1581-13-3 | 140 | 0 | 123 | 0 |
| HPHA (91.2) | 1581-17-2 | 140 | 0 | 135 | 0 |

Initial gums = 23 mg/100 ml unwashed and 17 mg/100 ml heptane washed
DEHA = diethylhydroxylamine
HPHA = bis-(hydroxypropyl)hydroxylamine
% P = Percent Protection Based on Blanks The feedstock had aged by the time this test was conducted. It appears that the treatment concentration was no longer high enough to show good efficacy.

TABLE XIV

Heat Induced Gum Test Using Raw Pyrolysis Gasoline (212° F.) Sample No. 3

| Treatment (ppm active) | Lot No. | Gum content after polymerization: Unwashed Gum (mg/100 ml) | % P | Heptane Washed Gum | % P |
|---|---|---|---|---|---|
| Blank | — | 137 | — | 131 | — |
| DEHA (500) | — | 9 | 100 | 2 | 100 |
| HPHA (450) | 1507-250-F | 23 | 100 | 21 | 96 |
| HPHA (453) | 1581-13-3 | 12 | 100 | 6 | 100 |
| HPHA (456) | 1581-17-2 | 8 | 100 | 4 | 100 |

Initial gums = 23 mg/100 ml unwashed and 17 mg/100 ml heptane washed
DEHA = diethylhydroxylamine
HPHA = bis-(hydroxypropyl)hydroxylamine
% P = Percent Protection Based on Blanks The results of Tables IV through XIV indicate that the hydroxyalkylhydroxylamine compounds of the present invention perform as effectively as polymerization inhibitors as known inhibitors in non-oxygenated environments.

Table XV presents the results of the Vazo initiator induced polymerization test. This test is identical to the heat induced gum test except that a polymerization initiator is added to the sample.

TABLE XV

Vazo Initiator Induced Polymerization Test Using Raw Pyrolysis Gasoline (212° F.)

| Treatment (ppm active) | Lot Number | Polymer Weight mg/100 ml | % P |
|---|---|---|---|
| Blank | | 102 | — |
| DEHA (250) | | 50 | 51 |
| HBHA (232.5) | 1507-209-F | 73 | 28 |
| HPHA (225) | 1507-183-3 | 65 | 36 |
| HPHA (225) | 1507-216-F | 58 | 43 |
| HPHA (87.5) | 1507-218-F | 91 | 11 |

Initial Gum = 23 mg/100 ml
DEHA = diethylhydroxylamine
HBHA = bis-(hydroxybutyl)hydroxylamine
HPHA = bis-(hydroxypropyl)hydroxylamine
% P = Percent Protection based on blanks Again, these results show that hydroxyalkylhydroxylamines are as effective as known polymerization inhibitors in non-oxygenated environments.

Table XVI reports the results of the acrylate polymerization test. This test is run under inert (non-oxygen containing) atmosphere. Temperature is monitored and the polymerization exotherm is recorded. The time to exotherm is a measure of effective polymerization inhibition.

TABLE XVI

Acrylate polymerization Test

| Additive 1 (ppm active) | Additive 2 (ppm active) | Minutes to Exotherm |
|---|---|---|
| Blank | — | 8 |
| HPHA (1.7) | — | 8 |
| PDA (2) | HPHA (1.7) | 18 |
| HPHA (1.7) | | 11 |
| PDA (2) | HPHA (1.7) | 47 |
| HPHA (1.7) | | 9 |
| PDA (2) | HPHA (1.7) | 45 |
| HPHA (1.8) | | 11 |
| PDA (2) | HPHA (1.8) | 47 |
| HPHA (1.7) | | 11 |
| PDA (2) | HPHA (1.7) | 54 |

PDA = phenylenediamine compound
HPHA = bis-(hydroxypropyl)hydroxylamine

The above results show that hydroxyalkylhydroxylamines are ineffective as an acrylate polymerization inhibitor in the test conditions employed.

Table XVII represents the results of the oxygen uptake test. The polymerization inhibitor is fixed with a small amount of copper naphthenate. An organic amine (aminoethylpiperazine in HAN) is added to impart basicity. Oxygen overpressure is applied to the closed pressure vessel and heat is applied. Oxygen pressure is measured versus time. A large pressure drop is reflective of the materials ability to absorb oxygen.

TABLE XVII

Oxygen Uptake Test

| Treatment (g) | Lot No. | Pressure Drop (psig) at time interval 7 Min. | 27 Min. | 123 Min. | 252 Min. |
|---|---|---|---|---|---|
| DEHA (5.0) | | 38 | 45 | 47 | 47 |

TABLE XVII-continued

Oxygen Uptake Test

| Treatment (g) | Lot No. | Pressure Drop (psig) at time interval 7 Min. | 27 Min. | 123 Min. | 252 Min. |
|---|---|---|---|---|---|
| HPHA* (0.75) | 1507-225-F | 1 | 10 | 24 | 31 |
| HPHA (4.75) | 1507-223-F | 1 | 2 | 3 | 3 |
| HPHA (4.75) | 1507-239-F | 1 | 3 | 5 | 8 |
| HPHA (4.5) | 1507-248-F | 1 | 3 | 6 | 8 |
| HPHA (4.5) | 1507-250-F | 3 | 7 | 15 | 21 |
| HPHA (4.25) | 1507-276-2 | 4 | 9 | 18 | 24 |

DEHA = Diethylhydroxylamine
HPHA = bis-(hydroxypropyl)hydroxylamine
*lots of N—OH in sample, but very little HPHA These results indicate the compounds of the present invention are less likely to react with oxygen and will remain unreacted to inhibit polymerization in hydrocarbon streams containing dissolved oxygen.

In accordance with the patent statutes, the best mode of practicing the invention has been set forth. However, it will be apparent to those skilled in the art that many other modifications can be made without departing from the invention herein disclosed and described, the scope of the invention being limited only by the scope of the attached claims.

Having thus described the invention, what we claim is:

1. A method for inhibiting the polymerization of hydrocarbon fluids containing dissolved oxygen comprising adding to said hydrocarbon an effective polymerization inhibiting amount of a hydroxyalkylhydroxylamine compound wherein the alkyl has a carbon range from about 2 to about 12.

2. The method as claimed in claim 1 wherein said hydroxyalkylhydroxylamine compound has the formula:

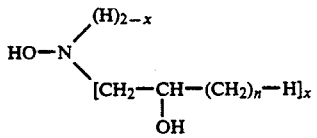

wherein n ranges from about 0 to about 10 and x is 1 or 2.

3. The method as claimed in claim 2 wherein said hydroxyalk-ylhydroxylamine compound is bis-(hydrox propyl)hydroxylamine.

4. The method as claimed in claim 2 wherein said hydroxyalkylhydroxylamine compound is bis-(hydroxybutyl)hydroxylamine.

5. The method as claimed in claim 2 wherein said hydroxyalkylhydroxylamine compound is hydroxypropylhydroxylamine.

6. The method as claimed in claim 2 wherein said hydroxyalkylhydroxylamine compound is hydroxybutylhydroxylamine.

7. The method as claimed in claim 1 wherein said hydroxyalkylhydroxylamine compound is added to said hydrocarbon in an amount from about 1 part per million to about 1000 parts per million parts hydrocarbon.

8. The method as claimed in claim 1 wherein said hydroxyalkylhydroxylamine compound is dissolved in a carrier solvent.

9. The method as claimed in claim 8 wherein said solvent is octanol.

10. The method as claimed in claim 1 wherein said hydrocarbon is an olefin containing fluid.

* * * * *